US010563544B2

(12) United States Patent
Kim

(10) Patent No.: US 10,563,544 B2
(45) Date of Patent: Feb. 18, 2020

(54) CONTINUOUS VARIABLE VALVE DURATION APPARATUS AND ENGINE PROVIDED WITH THE SAME

(71) Applicants: Hyundai Motor Company, Seoul (KR); Kia Motors Corporation, Seoul (KR)

(72) Inventor: Kyung Mo Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 310 days.

(21) Appl. No.: 15/668,498

(22) Filed: Aug. 3, 2017

(65) Prior Publication Data

US 2018/0163575 A1 Jun. 14, 2018

(30) Foreign Application Priority Data

Dec. 13, 2016 (KR) ..... 10-2016-0169855

(51) Int. Cl.

| | |
|---|---|
| ***F01L 1/053*** | (2006.01) |
| ***F01L 1/047*** | (2006.01) |
| ***F01L 13/00*** | (2006.01) |
| ***F01L 1/18*** | (2006.01) |
| *F01L 1/356* | (2006.01) |

(Continued)

(52) U.S. Cl.

CPC ..... *F01L 1/053* (2013.01); *F01L 1/18* (2013.01); *F01L 1/181* (2013.01); *F01L 13/0015* (2013.01); *F01L 1/08* (2013.01); *F01L 1/267* (2013.01); *F01L 1/356* (2013.01); *F01L 13/0026* (2013.01); *F01L 2001/0473* (2013.01); *F01L 2001/0476* (2013.01); *F01L 2001/0535* (2013.01); *F01L 2013/103* (2013.01); *F01L 2105/00* (2013.01); *F01L 2820/01* (2013.01)

(58) Field of Classification Search

CPC ... F01L 1/053; F01L 1/18; F01L 1/181; F01L 1/08; F01L 1/267; F01L 1/356; F01L 13/0015; F01L 13/0026; F01L 13/103; F01L 2001/0473; F01L 2001/0476; F01L 2001/0535; F01L 2105/00; F01L 2820/01

USPC ..... 123/90.16, 90.15, 90.17

See application file for complete search history.

(56) References Cited

U.S. PATENT DOCUMENTS

2017/0089229 A1* 3/2017 Kim ..... F01L 1/047
2017/0107866 A1* 4/2017 Kim ..... F01L 1/047

(Continued)

*Primary Examiner* — Devon C Kramer
*Assistant Examiner* — Kelsey L Stanek
(74) *Attorney, Agent, or Firm* — Morgan, Lewis & Bockius LLP

(57) ABSTRACT

A continuous variable valve duration system may include a camshaft, a first cam portion including a first cam, of which the camshaft is inserted therein, an internal bracket transmitting rotation of the camshaft to the first cam portion, a control shaft parallel to the camshaft, a slider housing in which the internal bracket is rotatably inserted, on which a control groove where the control shaft is inserted into is formed, and the slider housing movable vertical to the camshaft, a guider configured for guiding movement of the slider housing, a rocker shaft, a first rocker arm rotatably disposed to the rocker shaft of which a first end portion contacts with the first cam and of which a second end portion is connected to a first valve and a control portion selectively rotating the control shaft for changing a position of the slider housing.

21 Claims, 12 Drawing Sheets

(51) Int. Cl.
*F01L 1/08* (2006.01)
*F01L 1/26* (2006.01)

(56) References Cited

U.S. PATENT DOCUMENTS

2017/0114680 A1* 4/2017 Kim ..... F01L 1/047
2017/0167319 A1* 6/2017 Kim ..... F01L 13/0015

* cited by examiner

CONTINUOUS VARIABLE VALVE DURATION APPARATUS AND ENGINE PROVIDED WITH THE SAME

CROSS-REFERENCE TO RELATED APPLICATION

The present application claims priority to Korean Patent Application No. 10-2016-0169855 filed on Dec. 13, 2016, the entire contents of which is incorporated herein for all purposes by this reference.

BACKGROUND OF THE INVENTION

Field of the Invention

The present invention relates to a continuous variable valve duration system and an engine provided with the same. More particularly, the present invention relates to a continuous variable valve duration system an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening or closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a continuous variable valve duration system and an engine provided with the same which may vary opening duration of a valve according to operation conditions of an engine, with a simple construction.

A continuous variable valve duration system according to aspects of the present invention may be applied to a Single OverHead Cam (SOHC) engine to reduce weight of the engine and driving resistance.

A continuous variable valve duration system according to an exemplary embodiment of the present invention may include a camshaft, a first cam portion including a first cam, of which the camshaft is inserted therein and of which a relative phase angle of the first cam with respect to the camshaft is configured to be variable, an internal bracket configured for transmitting a rotation of the camshaft to the first cam portion, a control shaft parallel to the camshaft, a slider housing in which the internal bracket is rotatably inserted, on which a control groove where the control shaft is inserted into is formed, and the slider housing movable vertical to the camshaft, a guider configured for guiding a movement of the slider housing, a rocker shaft, a first rocker arm rotatably disposed to the rocker shaft of which a first end portion is configured to contact with the first cam and of which a second end portion is connected to a first valve and a control portion configured for selectively rotating the control shaft for changing a position of the slider housing.

The continuous variable valve duration system may further include an eccentric rod connected the control shaft and inserted into the control groove.

A guide hole may be formed at the slider housing and the guider may include a guide shaft inserted into the guide hole and guiding movement of the slider housing and a guide shaft support portion configured for supporting the guide shaft.

At least one guide shaft may be disposed.

A first slot and a second slot may be formed at the internal bracket and the continuous variable valve duration system may further include a first slider pin slidably connected to the camshaft and rotatably inserted into the first slot and a second slider pin on which a pin slot is formed and rotatably inserted into the second slot.

The first slider pin may include a pin body slidably connected to the camshaft along a longitudinal direction thereof and a pin head inserted into the first slot.

The first cam portion may further include an external shaft on which a wheel key inserted into the pin slot is formed and of which the camshaft is inserted, and to which the first cam is connected.

The continuous variable valve duration system may further include a first bridge connected to the second end portion of the first rocker arm, and two first valves may be connected to the first bridge.

The continuous variable valve duration system may further include a second cam portion including a second cam rotating with the camshaft and a second rocker arm rotatably connected to the rocker shaft, of which a first end portion contacts with the second cam and of which a second end portion is connected to a second valve.

The continuous variable valve duration system may further include a second bridge connected to the second end portion of the second rocker arm, and two second valves may be connected to the second bridge.

The first cam portion may further include an external shaft on which a wheel key inserted into the pin slot is formed, of which the camshaft is inserted, on which guide slot is formed along a circumferential direction and the external shaft to which the first cam is connected.

The continuous variable valve duration system may further include a first bridge connected to the second end portion of the first rocker arm, and two first valves may be connected to the first bridge.

The continuous variable valve duration system may further include a second cam portion including a second cam connected to the camshaft through the guide slot and a second rocker arm rotatably connected to the rocker shaft, of which a first end portion contacts with the second cam and of which a second end portion is connected to a second valve.

The continuous variable valve duration system may further include a second bridge connected to the second end portion of the second rocker arm, and two second valves may be connected to the second bridge.

The continuous variable valve duration system may further include a support on which a control shaft supporting portion configured for rotatably supporting the control shaft is formed.

The guide shaft support portion may be integrally formed with the support.

The continuous variable valve duration system may further include a cam cap configured for rotatably supporting the camshaft.

A rocker shaft supporting portion configured for supporting the rocker shaft may be formed at the cam cap.

The support may be connected to the cam cap.

The continuous variable valve duration system may further include a bearing disposed between the internal bracket and the slider housing.

An engine according to an exemplary embodiment of the present invention may be provided with the continuous variable valve duration system.

As described above, a continuous variable valve duration system according to an exemplary embodiment of the present invention may vary an opening duration of a valve according to operation conditions of an engine, with a simple construction.

The continuous variable valve duration system according to an exemplary embodiment of the present invention may be reduced in size and thus an entire height of a valve train may be reduced.

Since the continuous variable valve duration system may be applied to a conventional engine without excessive modification, thus productivity may be enhance and production cost may be reduced.

Also, since the slider housing moves along a horizontal direction of an engine, thus instability or noise due to vertical direction load of a cam may be suppressed.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
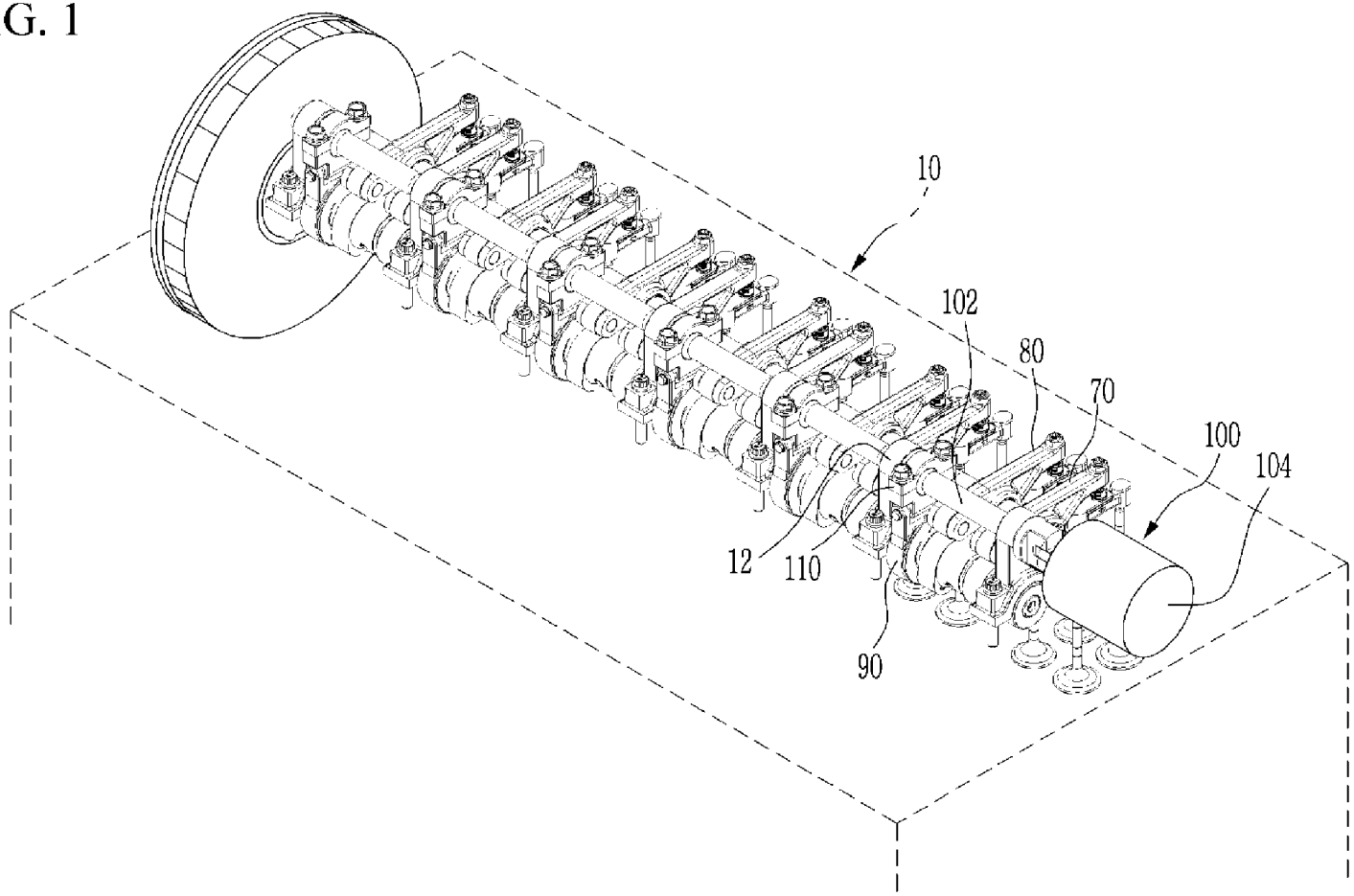
FIG. 1 is a perspective view of an engine provided with a continuous variable valve duration system according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
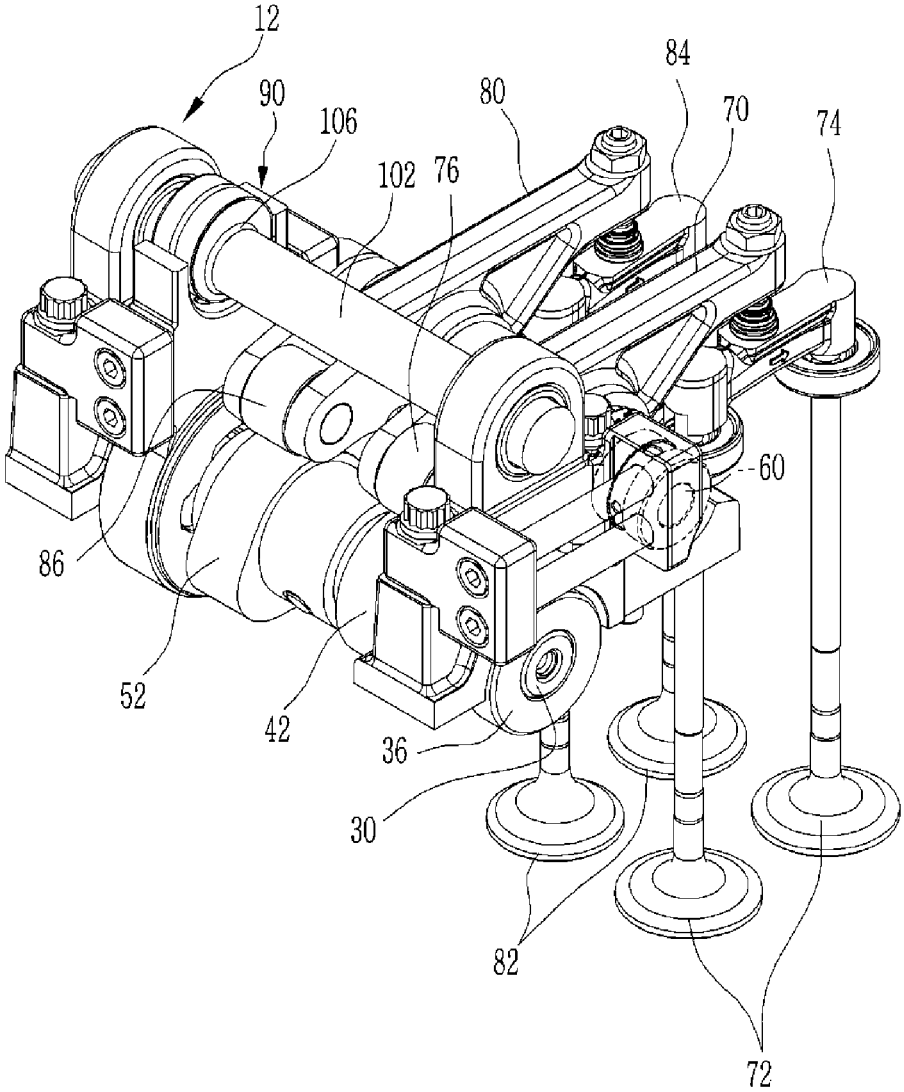
FIG. 2 is a perspective view of a continuous variable valve duration system according to an exemplary embodiment of the present invention.

FIG. 1 is a perspective view of an engine provided with a continuous variable valve duration system according to an exemplary embodiment of the present invention and FIG. 2 is a perspective view of a continuous variable valve duration system according to an exemplary embodiment of the present invention.

Figure 3:
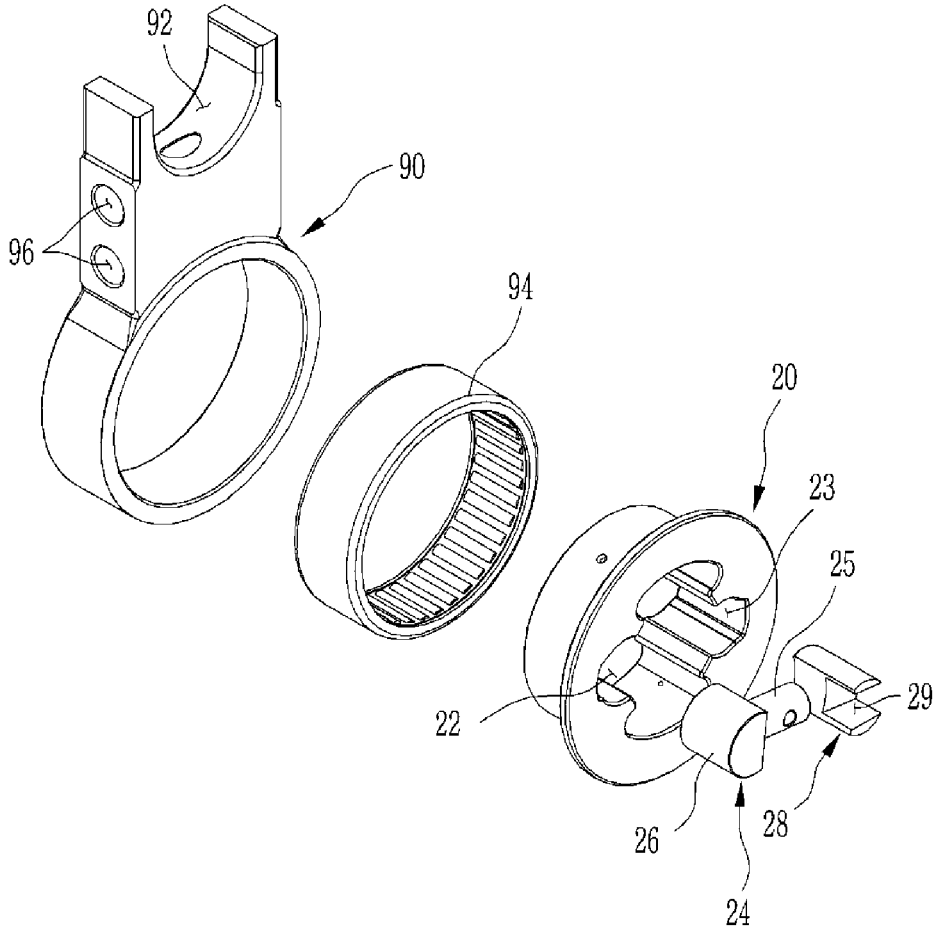
FIG. 3 is a partial exploded perspective view of a slider housing of a continuous variable valve duration system according to an exemplary embodiment of the present invention.
Figure 4:
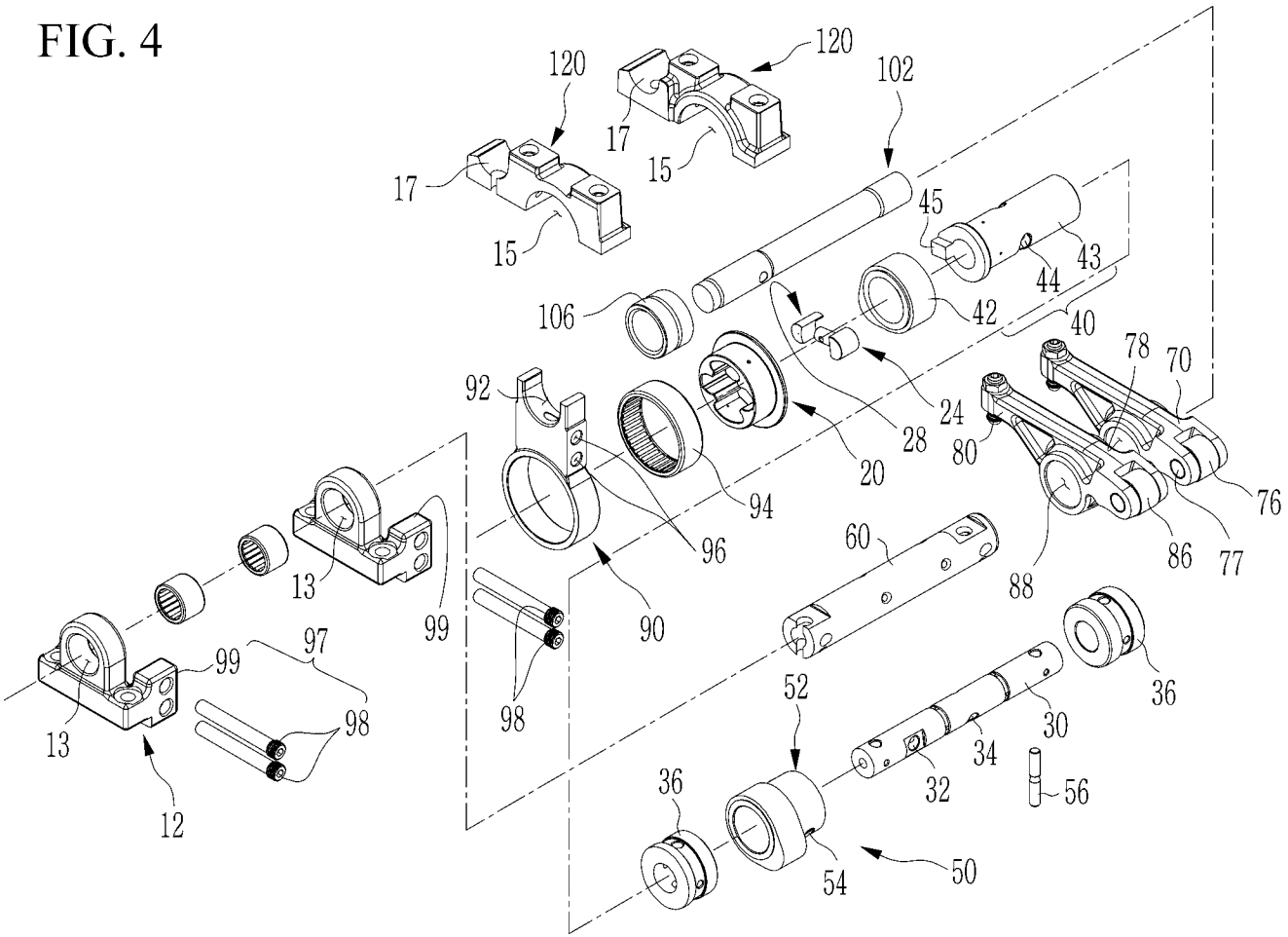
FIG. 4 is an exploded perspective view of a slider housing of a continuous variable valve duration system according to an exemplary embodiment of the present invention.

FIG. 3 is a partial exploded perspective view of a slider housing of a continuous variable valve duration system according to an exemplary embodiment of the present invention and FIG. 4 is an exploded perspective view of a slider housing of a continuous variable valve duration system according to an exemplary embodiment of the present invention.

Figure 5:
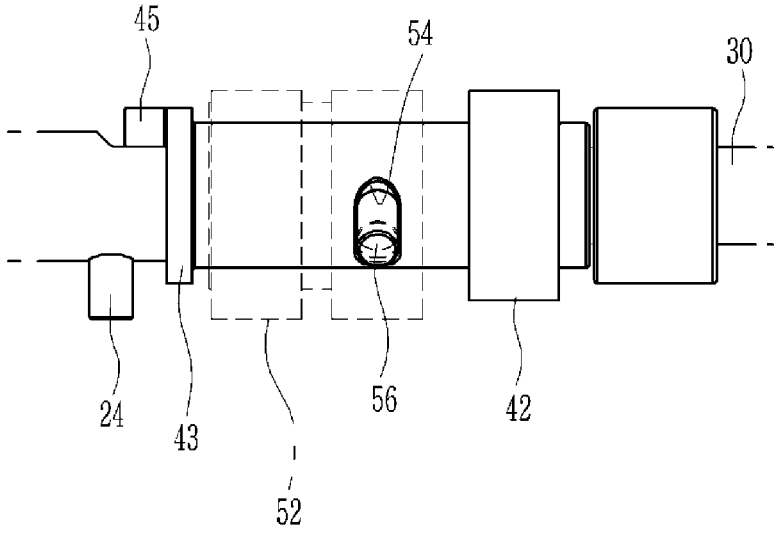
FIG. 5 is a drawing showing a first and a second cam portion of a continuous variable valve duration system according to an exemplary embodiment of the present invention.

FIG. 5 is a drawing showing a first and a second cam portion of a continuous variable valve duration system according to an exemplary embodiment of the present invention.

Referring to FIG. 1 to FIG. 5, an engine 10 according to an exemplary embodiment of the present invention is provided with a continuous variable valve duration system.

The continuous variable valve duration system according to an exemplary embodiment of the present invention may include a camshaft 30, a first cam portion 40 including a first cam 42, of which the camshaft is 30 inserted therein and of which relative phase angle of the first cam 42 with respect to the camshaft 30 is variable, an internal bracket 20 transmitting rotation of the camshaft 30 to the first cam portion 40, a control shaft 102 parallel to the camshaft 30, a slider housing 90 in which the internal bracket 20 is rotatably inserted, on which a control groove 92 where the control shaft 102 is inserted into is formed, and the slider housing 90 movable vertical to the camshaft 30, a guider 97 configured for guiding movement of the slider housing 90, a rocker shaft 60, a first rocker arm 70 rotatably disposed to the rocker shaft 60 of which a first end portion contacts with the first cam 42 and of which a second end portion is connected to a first valve 72 and a control portion 100 selectively rotating the control shaft 102 for changing a position of the slider housing 90.

An eccentric rod 106 is connected to the control shaft 102 and inserted into the control groove 92 and the eccentric rod 106 is eccentrically connected to the control shaft 102.

A guide hole 96 is formed at the slider housing 90 and the guider 97 includes a guide shaft 98 inserted into the guide hole 96 and guiding movement of the slider housing 90 and a guide shaft support portion 99 supporting the guide shaft 98.

At least one guide shaft 98 may be disposed.

That is, with one guide shaft element numbers may be reduced, and as shown in drawings, two or more guide shafts 98 may be disposed for stably guiding movement of the slider housing 90.

Due to manufacturing tolerance vibration or noise of the slider housing 90 generated, however two or more guide shafts may induce stable movement of the slider housing 90 and may suppress noise and vibration of the slider housing 90.

The control portion 100 includes control motor 104 selectively rotating the control shaft 102 and a gear, a worm gear, a planetary gear and so on may be interposed between the control shaft 102 and the control motor 104 for reducing motor capacity.

The continuous variable valve duration system may further include a support 12 on which a control shaft supporting portion 13 rotatably supporting the control shaft 102 is formed.

The guide shaft support portion 99 and the support 12 may be integrally formed to reduce element numbers.

The continuous variable valve duration system may further include a cam cap 120 on which a camshaft supporting portion 15 rotatably supporting the camshaft 30 is formed.

A camshaft bearing 36 is connected to the camshaft 30 and mounted to the camshaft supporting portion 15.

A rocker shaft supporting portion 17 supporting the rocker shaft 60 is formed at the cam cap 120.

The support 12 may be connected to the cam cap 120 for simplifying engine layout.

A first slot 22 and a second slot 23 are formed at the internal bracket 20.

The continuous variable valve duration system further includes a first slider pin 24 slidably connected to the camshaft 30 and rotatably inserted into the first slot 22 and a second slider pin 28 on which a pin slot 29 is formed and rotatably inserted into the second slot 23.

The first slider pin 24 includes a pin body 25 slidably connected to the camshaft 30 along a longitudinal direction thereof and a pin head 26 inserted into the first slot 22. And a camshaft hole 32 is formed at the camshaft 30 and the pin body 25 is slidably inserted into the camshaft hole 32.

The first cam portion 40 further includes an external shaft 43 on which a wheel key 45 inserted into the pin slot 29 is formed, of which the camshaft 30 is inserted, and to which the first cam 42 is connected.

A first roller 76 contacting the first cam 42 is connected to the first end portion of the first rocker arm 70 and the first roller 76 is connected to the first bridge 74 through a roller pin 77.

A first bridge 74 is connected to the second end portion of the first rocker arm 70 and two first valves 72 is connected to the first bridge 74.

The continuous variable valve duration system further includes a second cam portion 50 including a second cam 52 rotating with the camshaft 30 and a second rocker arm 80 rotatably connected to the rocker shaft 60, of which a first end portion contacts with the second cam 52 and of which a second end portion is connected to a second valve 82.

A second roller 86 contacting the second cam 52 is connected to the first end portion of the second rocker arm 80 and the second roller 86 is connected to the second bridge 84 through a roller pin 87.

A second bridge 84 is connected to the second end portion of the second rocker arm 80 and two second valves 82 may be connected to the second bridge 80.

A first rocker arm hole 78 is formed at the first rocker arm 70, a second rocker arm hole 88 is formed at the second rocker arm 80 and the rocker shaft 60 is inserted into the first rocker arm hole 78 and the second rocker arm hole 88.

A guide slot 44 is formed at the external shaft 43 along circumferential direction and the second cam portion 55 is connected to the camshaft 30 through the guide slot 44.

A cam connecting hole 34 is formed at the camshaft 30, a cam hole 54 is formed at the second cam portion 50, a cam connecting pin 56 is inserted into the cam connecting hole 34 and the cam hole 54 and the guide slot 44 guides relative rotation of the cam connecting pin 56.

A bearing 94 is disposed between the internal bracket 20 and the slider housing 90 for rotatably supporting the internal bracket 20.

Figure 6:
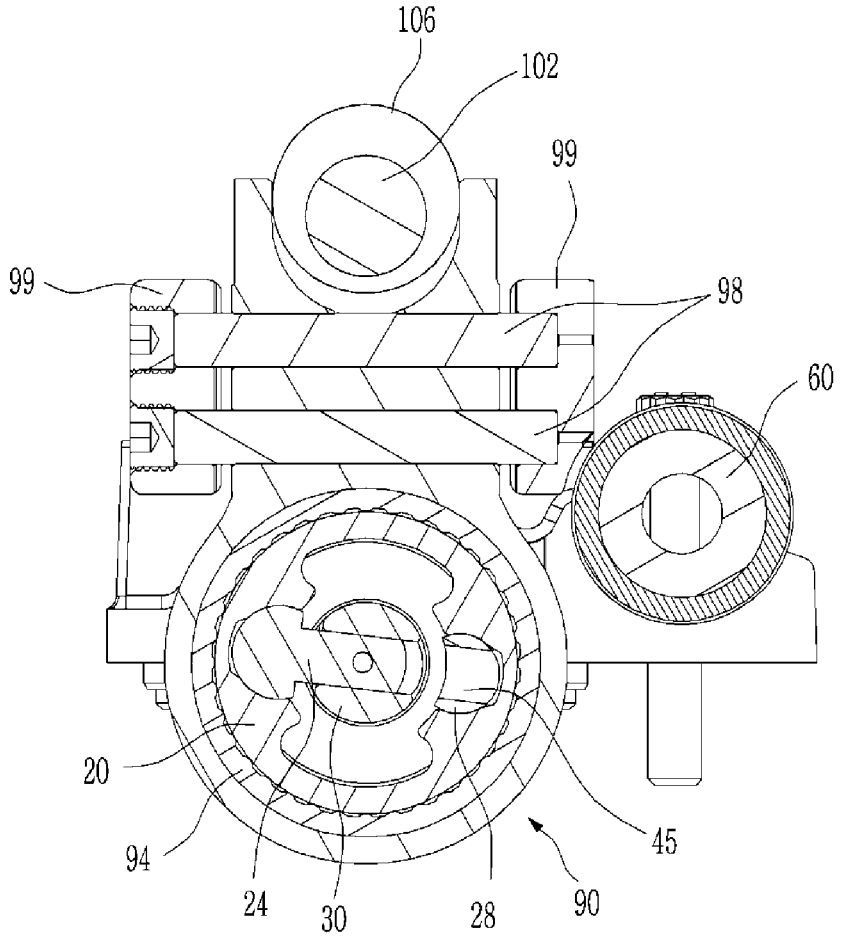
FIG. 6 and FIG. 7 are drawings showing operation of a continuous variable valve duration apparatus according to an exemplary embodiment of the present invention.
Figure 7:
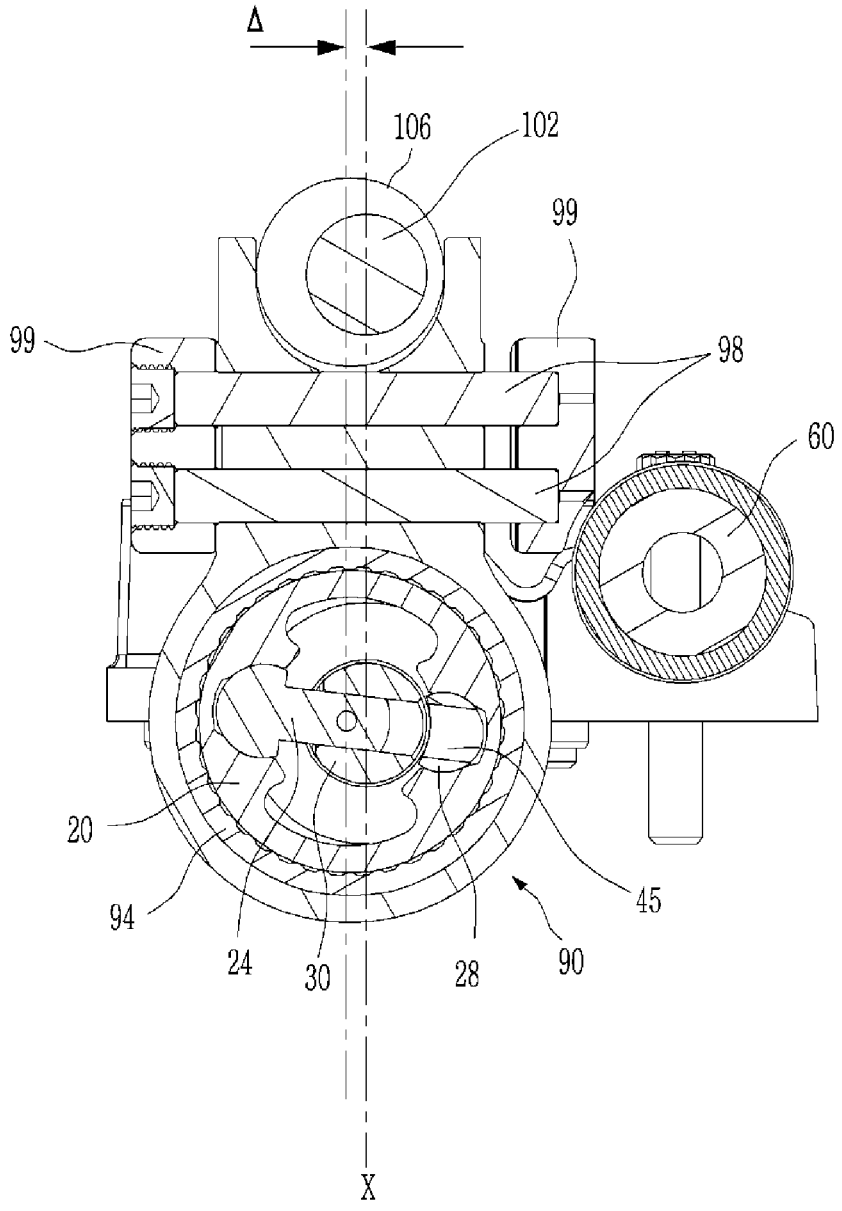
Figure 8:
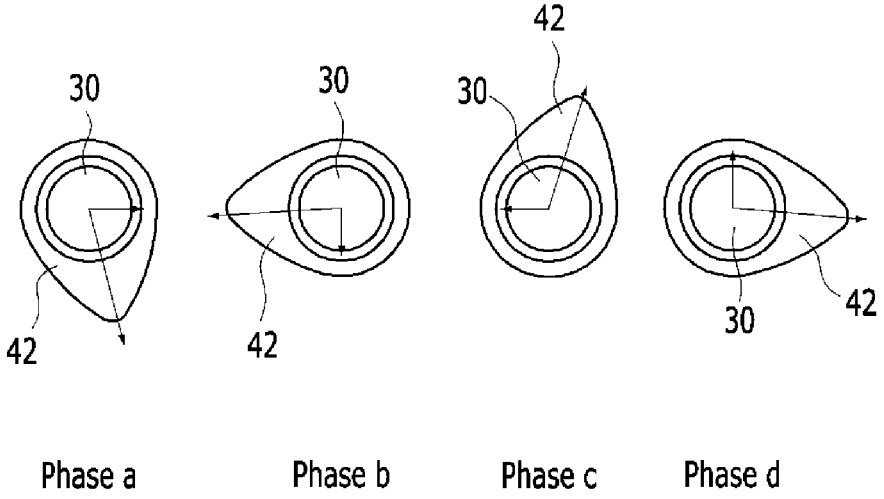
FIG. 8 and FIG. 9 are drawings showing mechanical motions of cams of a continuous variable valve duration apparatus according to an exemplary embodiment of the present invention.
Figure 9:
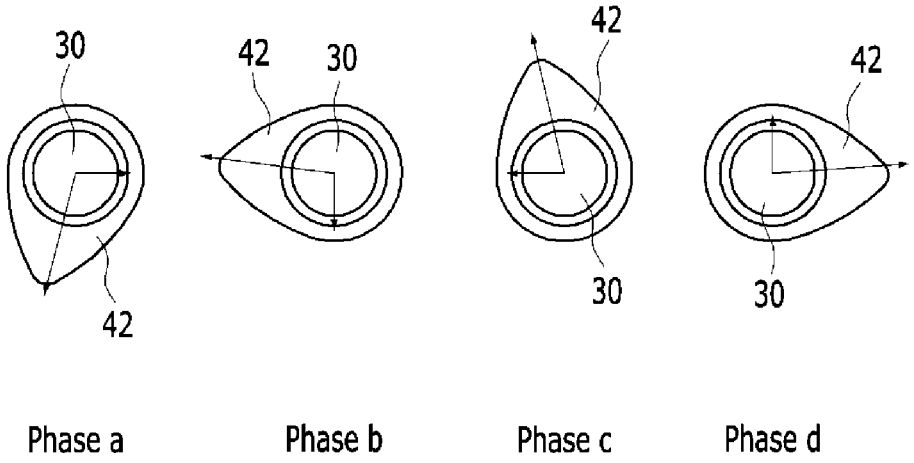

FIG. 6 and FIG. 7 are drawings showing operation of a continuous variable valve duration apparatus according to an exemplary embodiment of the present invention. FIG. 8 and FIG. 9 are drawings showing mechanical motions of cams of a continuous variable valve duration apparatus according to an exemplary embodiment of the present invention.

Referring to FIG. 1 to FIG. 9, operations of the continuous variable valve duration system according to various aspects of the present invention will be discussed.

As shown in FIG. 6, in the case that rotation centers of the camshaft 30 and the internal bracket 20 are coincident, the first cam 42 rotates with the same phase angle of the camshaft 30.

As shown in FIG. 7, when the control portion 100 is operated to rotate the control shaft 102, the eccentric rod 106 moves the slider housing 90 along a longitudinal direction of the guide shaft 98.

When a rotation center X of the camshaft 30 and the internal bracket 20 are not coincident according to operation of the control portion 100 as denoted as "A", rotation speed of the first cam 42 with respect to rotation speed of the camshaft 30 is changed.

That is, since the first slider pin 24 is slidable along length direction thereof with respect to the camshaft 30, the pin head 26 is rotatable within the first slot 22, the second slider pin 28 is rotatable within the second slot 23, and the wheel key 45 is slidable within the pin slot 29, such that the rotation speed of the first cam 42 with respect to the rotation speed of the camshaft 30 is changed when the rotation centers of the camshaft 30 and the internal bracket 20 are not coincident.

When the rotation center of the internal bracket 20 with respect to the camshaft 30 moves leftward in the drawing, the rotation speed of the first cam 42 is relatively faster than rotation speed of the camshaft 30 from phase a to phase b and from phase b to phase c, then the rotation speed of the first cam 42 is relatively slower than rotation speed of the camshaft 30 from phase c to phase d and from phase d to phase a as shown in FIG. 8.

When the rotation center of the internal bracket 20 with respect to the camshaft 30 moves rightward according to the operation of the control portion 100, the rotation speed of the first cam 42 is relatively slower than rotation speed of the camshaft 30 from phase a to phase b and from phase b to phase c, then the rotation speed of the first cam 42 is relatively faster than rotation speed of the camshaft 30 from phase c to phase d and from phase d to phase a as shown in FIG. 9.

According to the relative position of the internal bracket 20, timing of the first cam 42 to push the first roller 76 that is the timing of the first valve 72 is opened or closed is changed.

Figure 10:
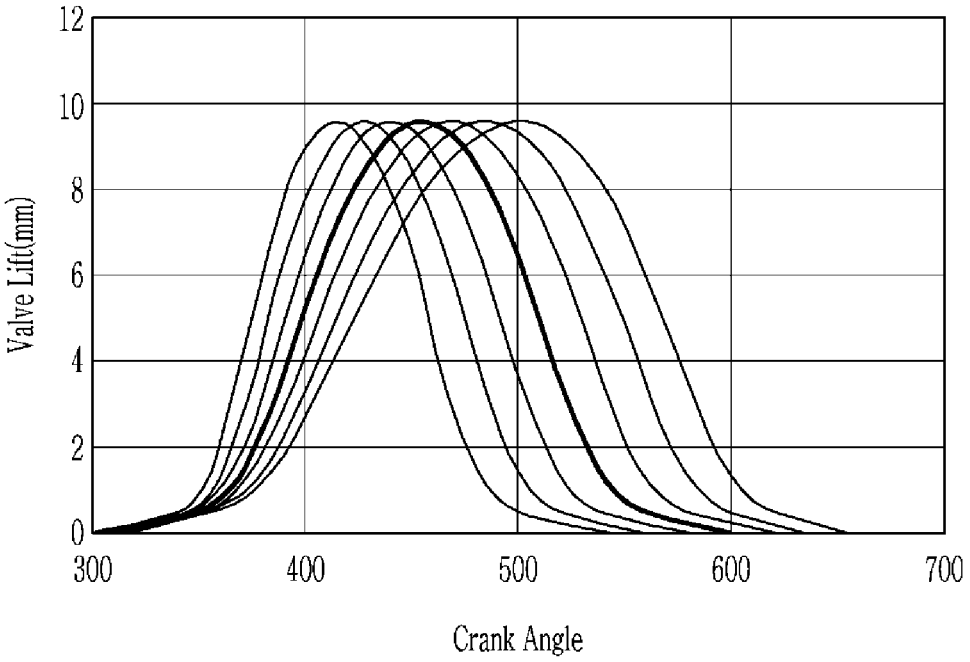
FIG. 10, FIG. 11, and FIG. 12 are graphs of a valve profile of a continuous variable valve duration apparatus according to an exemplary embodiment of the present invention.
Figure 11:
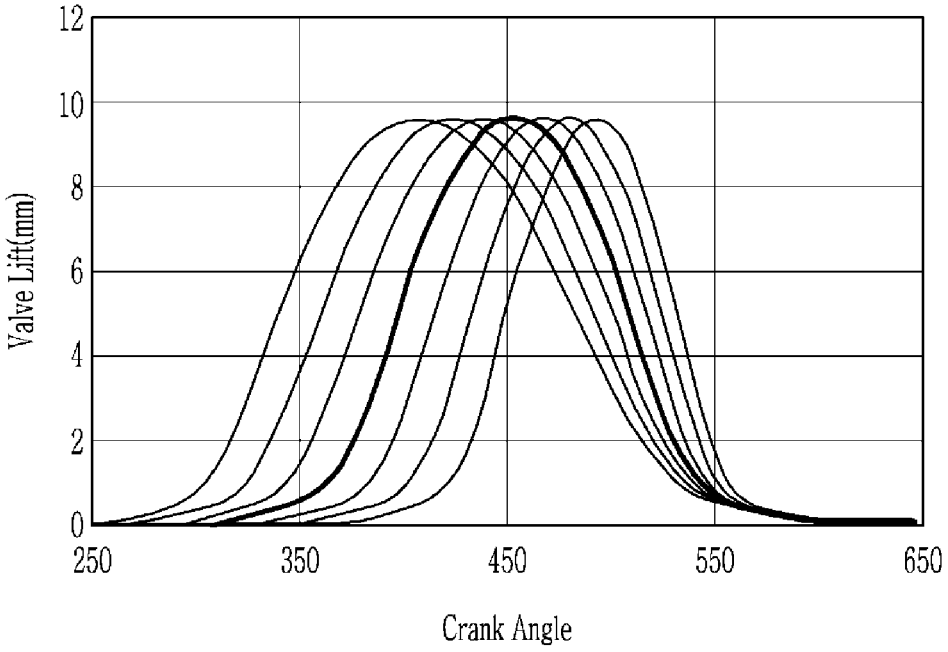
Figure 12:
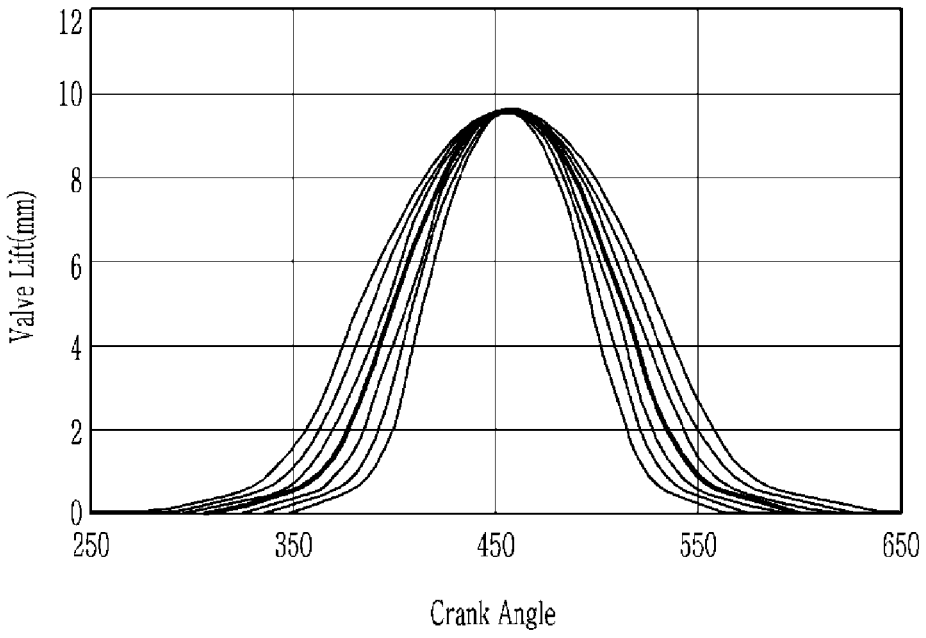

FIG. 10, FIG. 11, and FIG. 12 are graphs of a valve profile of a continuous variable valve duration apparatus according to an exemplary embodiment of the present invention.

The continuous variable valve duration system according to an exemplary embodiment of the present invention may perform various valve profiles according to contacting positions of the first cam 42 and the first roller 76, mounting angle of the first cam 42 and the first roller 76 and so on.

As shown in FIG. 10, opening time of the first valve 72 may be fixed while closing time of the first valve 72 is changed. Or the opening time of the first valve 72 may be changed while the closing time of the first valve 72 is fixed as shown in FIG. 11.

As shown in FIG. 13, peak time of the first valve 72 may be fixed while duration of the first valve 72 is changed.

As described above, a continuous variable valve duration system according to an exemplary embodiment of the present invention may vary an opening duration of a valve according to operation conditions of an engine, with a simple construction.

The continuous variable valve duration system according to an exemplary embodiment of the present invention may be reduced in size and thus an entire height of a valve train may be reduced.

Since the continuous variable valve duration system may be applied to a conventional engine without excessive modification, thus productivity may be enhance and production cost may be reduced.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration system comprising:

a camshaft;

a first cam portion including a first cam, of which the camshaft is inserted therein and of which a relative phase angle of the first cam with respect to the camshaft is configured to be variable;

an internal bracket configured for transmitting a rotation of the camshaft to the first cam portion;

a control shaft parallel to the camshaft;

a slider housing in which the internal bracket is rotatably inserted, on which a control groove where the control shaft is inserted into is formed, wherein the slider housing is configured to be movable vertical to the camshaft;

a guider configured for guiding a movement of the slider housing;

a rocker shaft;

a first rocker arm rotatably disposed to the rocker shaft of which a first end portion is configured to be in contact with the first cam and of which a second end portion is connected to a first valve; and a control portion configured for selectively rotating the control shaft for changing a position of the slider housing.

2. The continuous variable valve duration system of claim 1, further including an eccentric rod connected to the control shaft and inserted into the control groove.

3. The continuous variable valve duration system of claim 1, wherein a guide hole is formed at the slider housing; and wherein the guider includes:

a guide shaft inserted into the guide hole and configured for guiding a movement of the slider housing; and a guide shaft support portion configured for supporting the guide shaft.

4. The continuous variable valve duration system of claim 3, wherein at least one guide shaft including the guide shaft is mounted in at least one guide hole including the guide hole.

5. The continuous variable valve duration system of claim 3, further including a support on which a control shaft supporting portion configured for rotatably supporting the control shaft is formed.

6. The continuous variable valve duration system of claim 5, wherein the guide shaft support portion is integrally formed with the support.

7. The continuous variable valve duration system of claim 5, further including a cam cap configured for rotatably supporting the camshaft.

8. The continuous variable valve duration system of claim 5, wherein a rocker shaft supporting portion configured for supporting the rocker shaft is formed at the cam cap.

9. The continuous variable valve duration system of claim 5, wherein the support is connected to the cam cap.

10. The continuous variable valve duration system of claim 1, wherein a first slot and a second slot are formed at the internal bracket; and wherein the continuous variable valve duration system further includes:

a first slider pin slidably connected to the camshaft and rotatably inserted into the first slot; and a second slider pin on which a pin slot is formed and rotatably inserted into the second slot.

11. The continuous variable valve duration system claim 10, wherein the first slider pin includes:

a pin body slidably connected to the camshaft along a longitudinal direction thereof; and a pin head inserted into the first slot.

12. The continuous variable valve duration system of claim 10, wherein the first cam portion further includes an external shaft on which a wheel key inserted into the pin slot is formed, of which the camshaft is inserted, and to which the first cam is connected.

13. The continuous variable valve duration system of claim 12, further including a first bridge connected to the second end portion of the first rocker arm, and wherein two first valves are connected to the first bridge.

14. The continuous variable valve duration system of claim 12, further including:

a second cam portion including a second cam rotating with the camshaft; and a second rocker arm rotatably connected to the rocker shaft, of which a first end portion is configured to be in contact with the second cam and of which a second end portion is connected to a second valve.

15. The continuous variable valve duration system of claim 14, further including a second bridge connected to the second end portion of the second rocker arm, wherein two second valves are connected to the second bridge.

16. The continuous variable valve duration system of claim 10, wherein the first cam portion further includes an external shaft on which a wheel key inserted into the pin slot is formed, of which the camshaft is inserted, on which a guide slot is formed along a circumferential direction and the external shaft to which the first cam is connected.

17. The continuous variable valve duration system of claim 16, further including a first bridge connected to the second end portion of the first rocker arm, wherein two first valves are connected to the first bridge.

18. The continuous variable valve duration system of claim 16, further including:

a second cam portion including a second cam connected to the camshaft through the guide slot; and a second rocker arm rotatably connected to the rocker shaft, of which a first end portion is configured to be in contact with the second cam and of which a second end portion is connected to a second valve.

19. The continuous variable valve duration system of claim 18, further including a second bridge connected to the second end portion of the second rocker arm, wherein two second valves are connected to the second bridge.

20. The continuous variable valve duration system of claim 1, further including a bearing disposed between the internal bracket and the slider housing.

21. An engine provided with the continuous variable valve duration system of claim 1.

* * * * *